US008950613B2

(12) United States Patent
Nolan

(10) Patent No.: US 8,950,613 B2
(45) Date of Patent: Feb. 10, 2015

(54) BULK BIN CONTAINER WITH REMOVABLE SIDE WALL

(75) Inventor: Roger Nolan, Seymour, IN (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 13/397,025

(22) Filed: Feb. 15, 2012

(65) Prior Publication Data

US 2012/0205369 A1 Aug. 16, 2012

Related U.S. Application Data

(60) Provisional application No. 61/480,465, filed on Apr. 29, 2011, provisional application No. 61/443,538, filed on Feb. 16, 2011.

(51) Int. Cl.

| | |
|---|---|
| ***B65D 6/22*** | (2006.01) |
| ***B65D 6/24*** | (2006.01) |
| ***B65D 19/18*** | (2006.01) |

(52) U.S. Cl.

CPC ..... *B65D 19/18* (2013.01); *B65D 2519/00034* (2013.01); *B65D 2519/00069* (2013.01); *B65D 2519/00174* (2013.01); *B65D 2519/00587* (2013.01); *B65D 2519/00611* (2013.01); *B65D 2519/00805* (2013.01); *B65D 2519/0099* (2013.01)

USPC ..... 220/4.31; 220/4.33; 220/615; 220/617; 220/621

(58) Field of Classification Search

CPC ... B65D 11/18; B65D 11/1833; B65D 11/184

USPC ..... 220/4.28, 4.31, 4.33, 6, 615, 617, 621, 220/666, 7; 206/600

See application file for complete search history.

(56) References Cited

U.S. PATENT DOCUMENTS

| | | | | |
|---|---|---|---|---|
| 489,711 | A | | 1/1893 | Mandioni |
| 1,039,452 | A | | 9/1912 | Shepard |
| 1,280,629 | A | | 10/1918 | Appleby |
| 1,381,013 | A | | 6/1921 | Rainsford |
| 1,883,553 | A | * | 10/1932 | Chain ..... 220/4.34 |
| 2,579,655 | A | | 12/1951 | Donald |
| 3,246,828 | A | * | 4/1966 | Branscum et al. ..... 220/4.34 |
| 3,572,535 | A | | 3/1971 | Kinzie |
| 3,628,683 | A | | 12/1971 | Friedrich |
| 3,747,794 | A | | 7/1973 | Bitney |
| 3,874,546 | A | | 4/1975 | Sanders et al. |

(Continued)

FOREIGN PATENT DOCUMENTS

| | | |
|---|---|---|
| DE | 135488 | 11/1933 |
| EP | 0385914 A1 | 5/1990 |

(Continued)

*Primary Examiner* — Mickey Yu

*Assistant Examiner* — Brijesha V. Patel

(74) *Attorney, Agent, or Firm* — Ungaretti & Harris LLP

(57) ABSTRACT

A bulk bin container having a first side wall, a second side wall, a third side wall and a fourth side wall, where the first side wall is removable when the container is set up. The first side wall includes a removable hinge element. The first side wall also includes structure on a first side edge of the first side wall and second side edge of the first side wall that mates with corresponding structure on adjacent side walls and allows for the first side wall to be lifted straight upward and removed from the container upon removal of the removable hinge element.

19 Claims, 8 Drawing Sheets

(56) References Cited

U.S. PATENT DOCUMENTS

| | | | | |
|---|---|---|---|---|
| 3,924,293 | A | 12/1975 | Cain | |
| 3,977,044 | A | 8/1976 | Mort | |
| 4,063,330 | A | 12/1977 | Triplette | |
| 4,119,263 | A | 10/1978 | Cuthbertson et al. | |
| 4,186,841 | A | 2/1980 | Buckley et al. | |
| 4,192,430 | A | 3/1980 | Cornon | |
| 4,300,695 | A | 11/1981 | Hsu | |
| 4,454,946 | A | 6/1984 | Yokowo | |
| 4,591,065 | A | 5/1986 | Foy | |
| 4,674,647 | A | 6/1987 | Gyenge et al. | |
| 4,765,480 | A | 8/1988 | Malmanger | |
| 4,775,068 | A | 10/1988 | Reiland et al. | |
| 4,917,255 | A | 4/1990 | Foy et al. | |
| 4,923,079 | A | 5/1990 | Foy | |
| 4,960,223 | A * | 10/1990 | Chiang et al. | 220/7 |
| 4,967,927 | A | 11/1990 | Reiland et al. | |
| 4,987,639 | A | 1/1991 | Baiuley et al. | |
| 5,094,356 | A | 3/1992 | Miller | |
| 5,114,037 | A | 5/1992 | Hillis et al. | |
| 5,150,806 | A | 9/1992 | Glomski | |
| 5,199,592 | A | 4/1993 | Reiland et al. | |
| 5,289,935 | A | 3/1994 | Hillis et al. | |
| 5,398,835 | A | 3/1995 | Blinstrub | |
| 5,467,885 | A | 11/1995 | Blinstrub | |
| 5,474,197 | A | 12/1995 | Hillis et al. | |
| 5,501,353 | A | 3/1996 | Warren | |
| 5,538,178 | A | 7/1996 | Zink et al. | |
| 5,586,675 | A | 12/1996 | Borsboom et al. | |
| 5,660,291 | A | 8/1997 | Dash | |
| 5,711,444 | A | 1/1998 | Meacham et al. | |
| 5,725,119 | A | 3/1998 | Bradford et al. | |
| 5,788,103 | A | 8/1998 | Wagner et al. | |
| 5,845,799 | A | 12/1998 | Deaton | |
| 5,850,935 | A | 12/1998 | Luburic et al. | |
| 5,897,012 | A | 4/1999 | Sortwell | |
| 5,908,135 | A | 6/1999 | Bradford et al. | |
| 5,938,059 | A | 8/1999 | Luburic | |
| 6,029,839 | A | 2/2000 | Mansouri | |
| 6,062,410 | A | 5/2000 | Bradford et al. | |
| 6,088,239 | A | 7/2000 | Zeiss | |
| 6,135,287 | A | 10/2000 | Hartwall | |
| 6,186,932 | B1 | 2/2001 | Vallot | |
| 6,216,872 | B1 * | 4/2001 | Haasbroek | 206/512 |
| 6,216,899 | B1 * | 4/2001 | Vicari | 220/1.5 |
| 6,223,903 | B1 | 5/2001 | Mansouri | |
| 6,230,916 | B1 | 5/2001 | Bradford et al. | |
| 6,234,315 | B1 * | 5/2001 | Karpisek | 206/600 |
| 6,243,920 | B1 | 6/2001 | Sauve | |
| 6,283,319 | B1 | 9/2001 | Hillis et al. | |
| 6,293,417 | B1 | 9/2001 | Varfeldt | |
| 6,305,566 | B1 | 10/2001 | Pigott et al. | |
| 6,305,726 | B1 | 10/2001 | LeTrudet | |
| 6,415,938 | B1 * | 7/2002 | Karpisek | 220/1.5 |
| 6,416,271 | B1 | 7/2002 | Pigott et al. | |
| 6,422,409 | B2 | 7/2002 | Kofod | |
| 6,484,898 | B2 | 11/2002 | Hillis et al. | |
| RE37,915 | E | 12/2002 | Lapoint, III | |
| 6,540,096 | B1 | 4/2003 | Bazany et al. | |
| 6,543,659 | B2 | 4/2003 | Blair | |
| 6,691,885 | B2 | 2/2004 | Brown | |
| 6,726,046 | B2 | 4/2004 | Orset | |
| 6,776,300 | B2 | 8/2004 | Walsh et al. | |
| 6,783,032 | B2 | 8/2004 | Fons | |
| 6,783,058 | B2 | 8/2004 | Quaintance | |
| 6,786,394 | B2 | 9/2004 | Prince | |
| 6,805,254 | B2 | 10/2004 | Tanzer et al. | |
| 6,838,616 | B2 | 1/2005 | Harrison et al. | |
| 6,877,628 | B2 | 4/2005 | Nesting | |
| 6,902,061 | B1 | 6/2005 | Elstone | |
| 6,955,273 | B2 | 10/2005 | Hartwall | |
| 6,966,449 | B2 * | 11/2005 | Williams | 220/4.31 |
| 7,011,225 | B2 | 3/2006 | Oster et al. | |
| 7,032,765 | B2 | 4/2006 | Miller et al. | |
| 7,083,369 | B2 | 8/2006 | Nyeboer | |
| 7,128,209 | B2 | 10/2006 | Bringard et al. | |
| 7,137,522 | B2 | 11/2006 | Dubois | |
| 7,258,232 | B2 | 8/2007 | Bradford et al. | |
| 7,287,661 | B2 | 10/2007 | Knutsson et al. | |
| 7,311,220 | B2 | 12/2007 | Kellerer | |
| 7,331,480 | B1 | 2/2008 | Nolan | |
| 7,347,328 | B2 | 3/2008 | Hartwall | |
| 7,416,092 | B2 | 8/2008 | Dubois et al. | |
| 7,438,197 | B2 * | 10/2008 | Yamauchi | 220/7 |
| 7,484,634 | B2 | 2/2009 | Apps | |
| 7,540,390 | B2 | 6/2009 | Bublitz et al. | |
| 7,774,919 | B2 | 8/2010 | Bublitz et al. | |
| 7,828,167 | B2 | 11/2010 | Nolan | |
| 7,861,458 | B2 | 1/2011 | Apps et al. | |
| 2005/0224494 | A1 * | 10/2005 | Heinrichs | 220/4.28 |
| 2006/0237455 | A1 * | 10/2006 | Vargas | 220/4.34 |
| 2006/0249416 | A1 | 11/2006 | Bradford et al. | |
| 2007/0029319 | A1 | 2/2007 | Speck | |
| 2007/0056967 | A1 | 3/2007 | Dobrinski et al. | |
| 2007/0056977 | A1 | 3/2007 | Dobrinski et al. | |
| 2007/0068941 | A1 | 3/2007 | Dubois | |
| 2007/0075077 | A1 | 4/2007 | Dubois | |
| 2007/0158345 | A1 * | 7/2007 | Booth et al. | 220/6 |
| 2007/0181587 | A1 | 8/2007 | Burnham et al. | |
| 2008/0017638 | A1 | 1/2008 | Bradford | |
| 2008/0116199 | A1 | 5/2008 | Bublitz et al. | |
| 2008/0179322 | A1 * | 7/2008 | Parnall et al. | 220/6 |
| 2008/0203089 | A1 | 8/2008 | Hartwall | |
| 2009/0044376 | A1 | 2/2009 | Nolan | |
| 2009/0134057 | A1 * | 5/2009 | Hidalgo Vargas | 206/600 |
| 2009/0152265 | A1 | 6/2009 | Nolan | |
| 2009/0266813 | A1 | 10/2009 | Afflerbach et al. | |
| 2010/0018966 | A1 * | 1/2010 | Roberts et al. | 220/4.31 |
| 2010/0038331 | A1 | 2/2010 | Ydstrom | |
| 2010/0072199 | A1 | 3/2010 | Manuel | |
| 2010/0239730 | A1 * | 9/2010 | Ditter | 220/212 |
| 2010/0275426 | A1 | 11/2010 | Bublitz et al. | |
| 2011/0127275 | A1 | 6/2011 | Dubois | |
| 2011/0220643 | A1 | 9/2011 | Van Der Korput et al. | |
| 2011/0240639 | A1 | 10/2011 | Nolan | |

FOREIGN PATENT DOCUMENTS

| | | | |
|---|---|---|---|
| EP | 0485672 | A2 | 5/1992 |
| EP | 0785142 | | 7/1997 |
| EP | 0768229 | B1 | 7/1999 |
| EP | 1019293 | B1 | 5/2002 |
| EP | 0737152 | B1 | 8/2002 |
| EP | 1350728 | A2 | 10/2003 |
| EP | 1427641 | B1 | 6/2004 |
| EP | 1461259 | B1 | 9/2004 |
| EP | 1440011 | B1 | 6/2006 |
| EP | 1827942 | A2 | 9/2007 |
| EP | 1927552 | A2 | 6/2008 |
| EP | 1616803 | B1 | 10/2009 |
| FR | 80400 | | 10/1961 |
| FR | 2272907 | | 12/1975 |
| GB | 2426237 | B | 12/2008 |
| SE | 323908 | | 5/1970 |
| SE | 522095 | C2 | 1/2004 |
| WO | 0176960 | A1 | 10/2001 |
| WO | 03024815 | A1 | 3/2003 |
| WO | 03029090 | A1 | 4/2003 |
| WO | 03074376 | A1 | 9/2003 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |

* cited by examiner

BULK BIN CONTAINER WITH REMOVABLE SIDE WALL

CROSS-REFERENCE TO RELATED APPLICATIONS

The present application claims the benefit of Provisional Application No. 61/443,538 filed Feb. 16, 2011, and Provisional Application No. 61/480,465 filed Apr. 29, 2011, the contents of which are incorporated herein by reference.

FEDERALLY SPONSORED RESEARCH OR DEVELOPMENT

N/A

FIELD OF THE INVENTION

The present invention generally relates to a bulk bin container having a side wall that can be removed when the container is in a fully set up position.

Description of the Prior Art

Bulk bin containers are used to store and transport items. The containers include generally rectangular base portions and four side walls hingedly connected to the base portion. The side walls can be positioned in an upright, set up position, or can be collapsed inward for more efficient transport when empty.

One or more side walls of a bulk bin container can be provided with a hingedly connected door forming a portion of the side wall. The door allows for access to the interior of a set up container when another container (or other obstruction) covers the opening on top of the container. However, the door is typically only a portion of the side wall and limits such access.

In certain circumstances it is advantageous to remove an entire side wall of the container while the container is set up in a non-collapsed state (i.e., all four side walls are upright). However, in prior bulk bin designs, it is necessary to push the side wall into the interior of the container (e.g., about 1½ inches) in order to clear the coupling structure between the side walls in the corners of the container. This can be problematic if the container is filled. In contrast, the present design provides a unique corner joint that allows the side wall to be raised up straight vertically and then pulled out without requiring any movement toward the internal space of the container.

The present invention provides a bulk bin container with a removable side wall to provide additional access to the interior of the container.

SUMMARY OF THE INVENTION

The present invention provides a bulk bin container typically formed primarily from molded plastic components and metal or plastic hinge rods. The container includes a side wall that can be removed when all of the side walls are in a set up upright position without moving the side wall into the internal space of the container.

In accordance with one aspect of the invention, a bulk bin container with a removable side wall comprises a base portion, a first side wall connected to a first side of the base portion, a second side wall connected to a second side of the base portion, a third side wall connected to a third side of the base portion, and a fourth side wall connected to a fourth side of the base portion. The first side wall includes a first structure proximate a first edge of the side wall for removable connection to the second side wall, and a second structure on a second edge of the side wall for removable connection to the fourth side wall when all of the side walls are in an upright position. The first and second structure are configured to allow the side wall to be removed by raising the side wall straight upward (i.e. without requiring movement of the side wall into the internal space of the container). The second and fourth side walls can also include structure for cooperating with the first structure and second structure on the first side wall, respectively. Additionally, the container includes a hinge element, such as a hinge pin that is removably connected to the base portion and the first side wall. Other hinge configurations can also be used. It is only necessary that the hinge element allow the side wall to disengage from the base portion.

The first structure can be a plurality of L-shaped projections extending from the first edge of the first side wall. The second side wall can include a corresponding plurality of pockets configured to receive the L-shaped projections.

In another embodiment, the first structure is a plurality of pegs extending from the first edge. In this embodiment, the second side wall can include a corresponding plurality of slots configured to receive the pegs (e.g., slots open at the top so that upward movement of the side wall—once disengaged from the base—is unobstructed).

Each side wall can include an upper portion and a lower portion. Additionally, the side walls can be inwardly collapsible. In an alternative embodiment, the side wall can be a single unit. That is, the lower portion of the side wall (typically referred to as a collar or sleeve) can be absent, and the single side wall portion can be connected directly to the base portion of the bulk bin container. The side walls can be hingedly connected to collapse inward when not in use.

In accordance with another embodiment of the invention, a collapsible bulk bin container having a side wall that is removable when the container is in a set up un-collapsed state is provided. The container comprises a rectangular base portion having a first side, a second side, a third side and a fourth side. A first side wall is pivotably connected to the first side of the base portion by a disengage-able hinge element, such as a removable hinge pin The first side wall has a plurality of L-shaped projections extending from a first side edge, and a plurality of re-shaped projections extending from a second side edge. The container includes a second side wall pivotably connected to the second side of the base portion. The second side wall has a plurality of pockets on a first side edge for receiving the L-shaped projections on the first side edge of the first side wall. A third side wall is pivotably connected to the third side of the base portion and includes a plurality of pockets on a first side edge for receiving the L-shaped projections on the second side edge of the first side wall. A fourth side wall is pivotably connected to the fourth side of the base portion.

The collapsible container is formed from plastic. However, when a removable pin is utilized, the pin is preferably formed from metal, though can be engineered grade resins.

The collapsible container can farther include an access door in one or more of the first, second, third and fourth side wails.

The L-shaped projections are configured so that straight upward movement of the first side wall by about 3¼ inches disengages the L-projections from the pockets and allows one to remove the side wall. The L-shaped projections include an outermost portion extending downward.

In accordance with another embodiment, a collapsible bulk bin container having a side wail that is removable when the container is in an un-collapsed state is provided, The container comprises a rectangular base portion having a first side, a second side, a third side and a fourth side. A first side wall pivotably connected to the first side of the base portion by a disengage-able hinge element. The first side wail has a plurality of pockets along a first side edge, and a plurality of pockets along a second side edge. A second side wall is pivotably connected to the second side of the base portion. The second side wall has a plurality of projections on a first side edge for connection to the pockets on the first side edge of the first side wall. A third side wall is pivotably connected to the third side of the base portion. The third side wall has a plurality of projections on a first side edge for connection to the pockets on the second side edge of the first side wall. A fourth side wall is pivotably connected to the fourth side of the base portion.

The plurality of projections on the second side wall and the plurality of projections on the third side wall can be L-shaped projections. The L-shaped projections include an outermost portion extending downward.

Further aspects of the invention are disclosed in the description of the invention including the Figures.

BRIEF DESCRIPTION OF THE DRAWINGS

To understand the present invention, it will now be described by way of example, with reference to die accompanying drawings in which.

DETAILED DESCRIPTION

Figure 1:
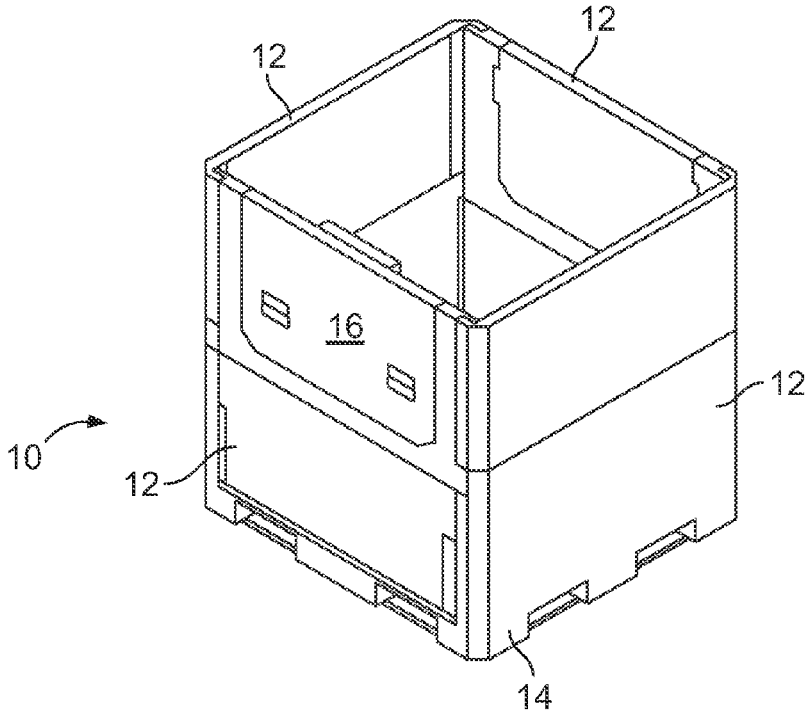
FIG. 1 is a perspective view of a bulk bin container of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The bulk bin container of the present invention is preferably sized to be 48"×45"×50". However, other dimensions can be used as desired or as required for a particular need or use of the container.

The container is configured to he stackable both when in an open set up, un-collapsed state (i.e. the side walls are positioned upward perpendicular to the base of the container) as well a when in a collapsed state with the side walls collapsed inward (the side walls are pivotably attached to the base portion to allow the container to be set up or collapsed). This container just happens to have a collapsed height of 29".

The bulk bin unit color is preferably black. However, other colors can be utilized as desired. A 4"×6" placard can be positioned on a front side of the bulk bin container for customer identification or instructions.

In accordance with the present invention, one of the side walls of the bulk bin container is removable when the bulk bin container is in a fully set-up state, allowing full access to the interior of the container while the other three side walls remain upright. The side wall can be removed by disengaging the side wall from the container (e.g., from a base portion or a collar connected to the base portion), lifting the side wall straight up vertically and pulling the side wall and collar away from the remainder of the container. The removable side wall, as well as the other side walls of the bulk bin container can also include a separate, smaller access door forming part of the side wall.

FIG. 1 is a perspective view of a bulk bin container 10 having four side walls 12 extending upward from a base 14. One of the side walls 12 is provided with, an access door 16. The access door 16 can be used to provide limited access to the interior of the container 10 (typically when another container, or other component, is stacked on top of the open end of the first container).

Figure 2:
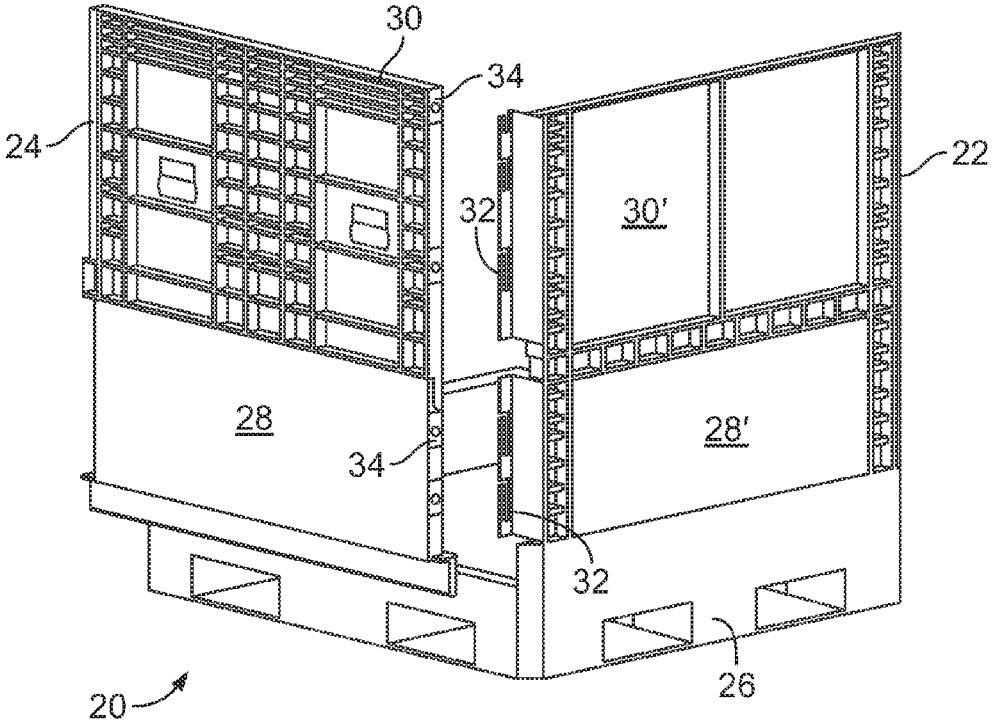
FIG. 2 is a perspective view of a bulk bin container of the present invention shown with one of the side walls separated from an adjacent side wall to illustrate the structure for connecting the side walls.

FIG. 2 discloses a partially exploded view of a container 20 of the present invention with a first side wall 22 in an upright position. The container 20 also includes a second side wall 24 shown in an upright position, but removed from a base portion 26 of the container 20. Each of the side walls 22, 24 shown have a first lower section 28, 28' and a second upper section 30, 30', The first lower section 28, 28' of the side walls can also be referred to as a collar or sleeve.

FIG. 2 illustrates structure on the edges of the side walls 22, 24 which facilitates placement and removal of the second side wall 24 from the base 26. in this embodiment, the first side wall 22 includes a plurality of open slots 32 configured to receive pegs 34 on the second side wall 24. However, other structure (including providing the reverse and modifying the structure on each of the edges) can be utilized to removably connect the second side wall 24 to the container 20. Similar structure can be used on the other edge of the second side wall 24 to mate with a third side wall (not shown in this Figure). The second side wall 24 is removed by sliding the second side wall generally straight upward (without requiring inward movement toward the internal space of the container) with respect to die first side wall 22 (and third side wail) to release the pegs 34 from the slots 32.

Figure 3:
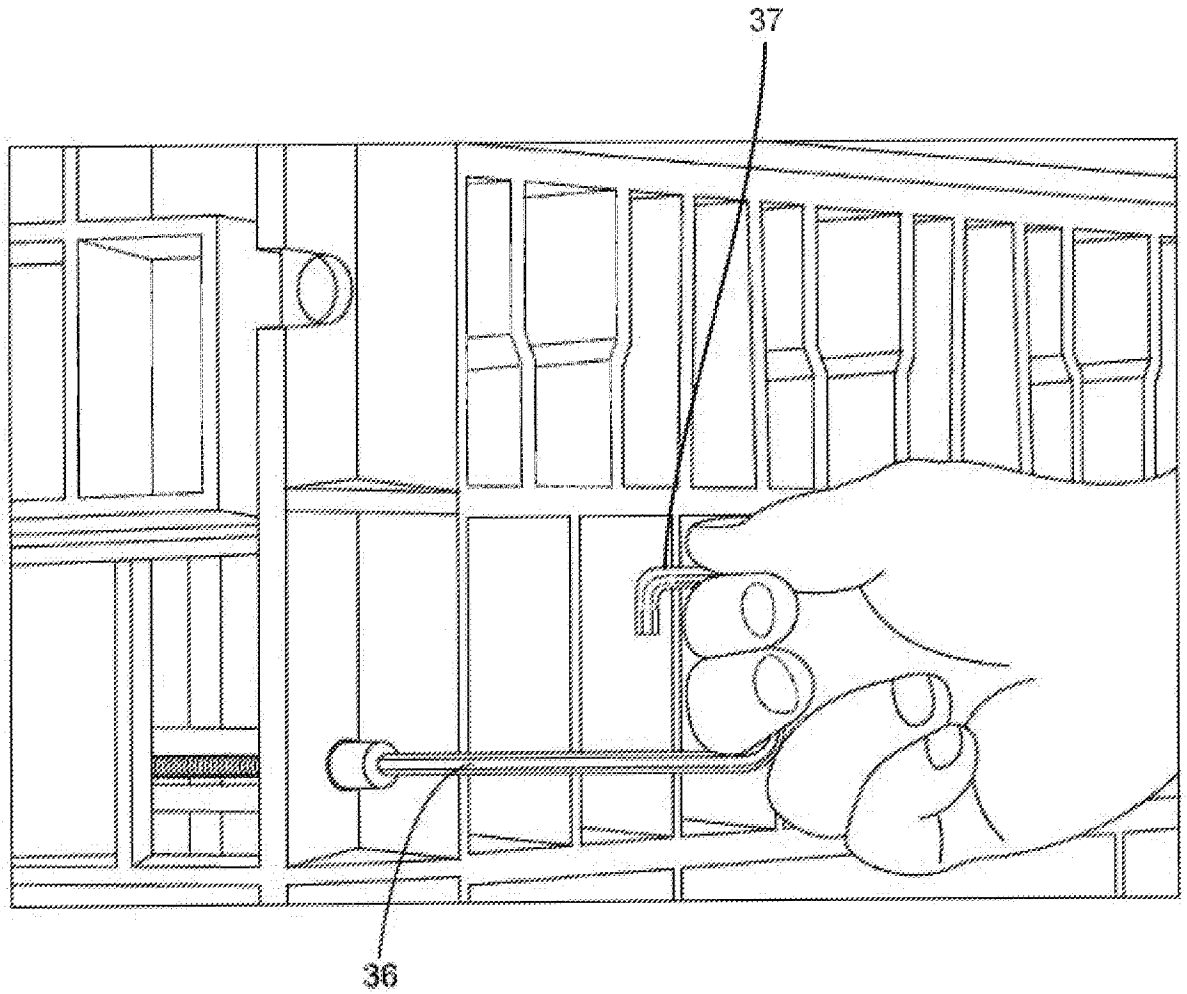
FIG. 3 is a photograph of a corner of a bulk bin container showing a hinge pin being removed from a side wall of the container.

Before the second side wall 24 can be removed from the container 20, it must be disengaged. A disengage-able hinge element, such as a removable hinge pin or rod 36 can be provided. The binge pin 36 can be removed by pulling it out of the container. A handle 37 is provided to facilitate removal as illustrated in FIG. 3.

Other disengage-able hinge elements can be utilized with the present invention. For example, spring-loaded pins can be used or molded-in leaf spring type lugs.

In one preferred embodiment, the side wall (including the lower side wall portion—or collar/sleeve) is removed by raising die side wall up by 3¼ inches as a unit to clear a hinge line to the base portion, and then pulled straight outward (away from the container) after removal of the hinge rod. The bulk bin container utilizes steel, removable hinge rods at the bottom of the side wall and a new corner joint design for the side walls (including the collar/sleeve).

Figure 4:
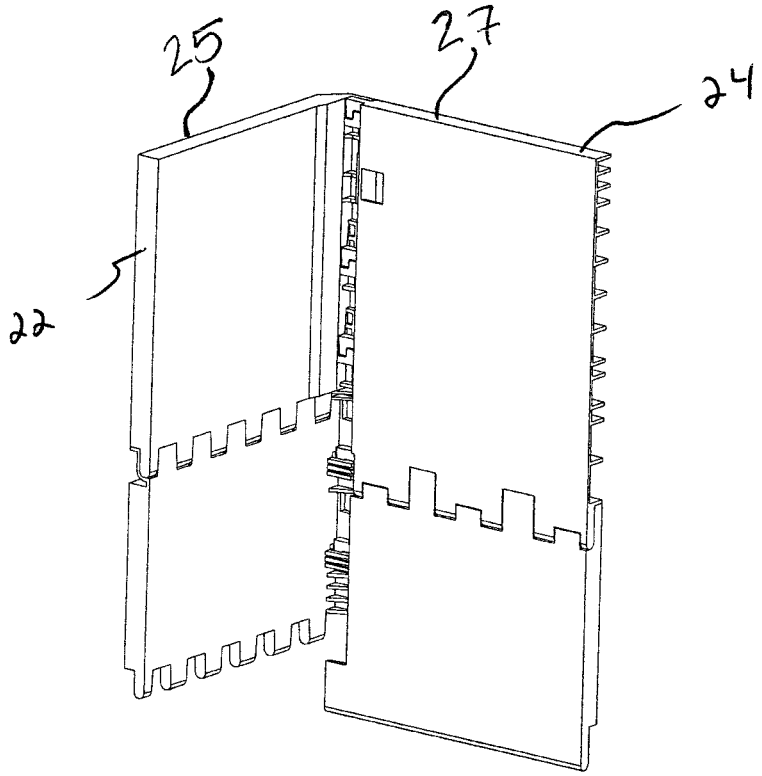
FIG. 4 is a perspective view of an interior side of two side walls of an alternative embodiment of the bulk bin container of the present invention.

FIGS. 4-10 illustrate another embodiment of the bulk bin container. Referring initially to FIG. 4, an interior side of a first side wall 22 and a second side wall 24 adjacent the first side wall 22 is shown. The base portion and other two side walls are not shown in any of FIGS. 4-10, but would necessarily be part of the bulk bin container. Instead, these Figures focus on the structure on the respective edges of the side walls forming the corner of the bulk bin container shown.

In FIG. 4, the top edges 25, 27 of both side walls 22, 24 are both even (i.e., lay in a plane). This is illustrative of the container with the side walls 22, 24 in an upright position. The base portion (for example, as shown with respect to the embodiment of FIG. 2) includes a higher portion proximate the first side wall 22. Without the base portion shown, the first side wall 22 appears to have a gap below its lower edge.

Figure 5:
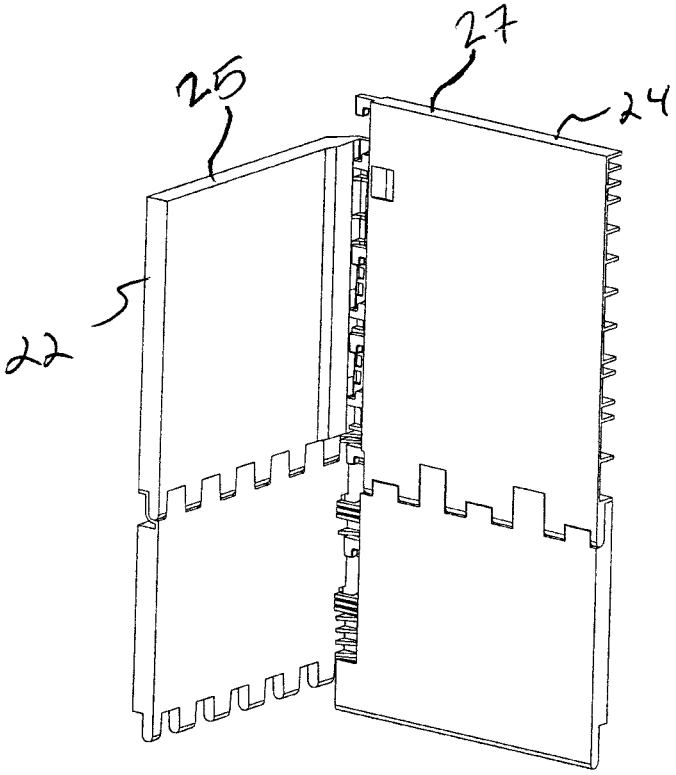
FIG. 5 is a perspective view of an interior side of the two side walls of FIG. 4 with one of the side walls shifted upward with respect to the other side wall.

FIG. 5 shows the second side wall 24 shifted upward with respect to the first side wall 22. This allows for the structure of the side edge of the second side wall 24 to disengage from structure on the side edge of the first side wall 22 to enable removal of the second side wall 24 from the bulk bin container. In this Figure, the top edge 27 of the second side wall 24 is noticeably higher than the top edge 25 of the first side wall.

Figure 6:
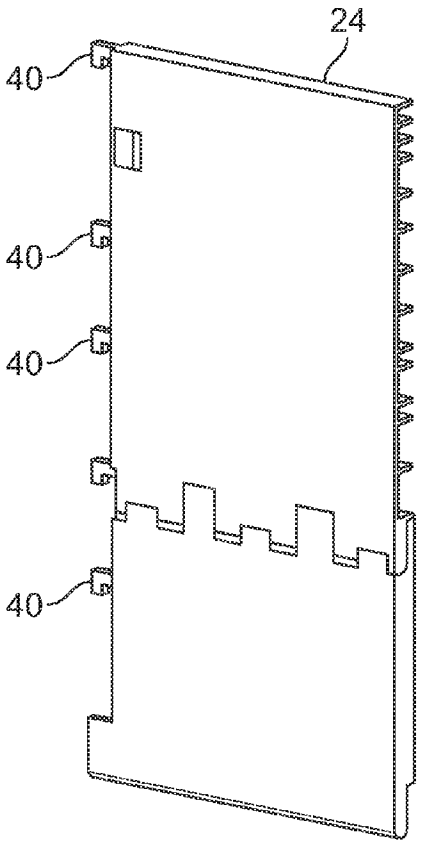
FIG. 6 is a perspective view of an interior side of a first one of the two side walls of FIG. 4.
Figure 7:
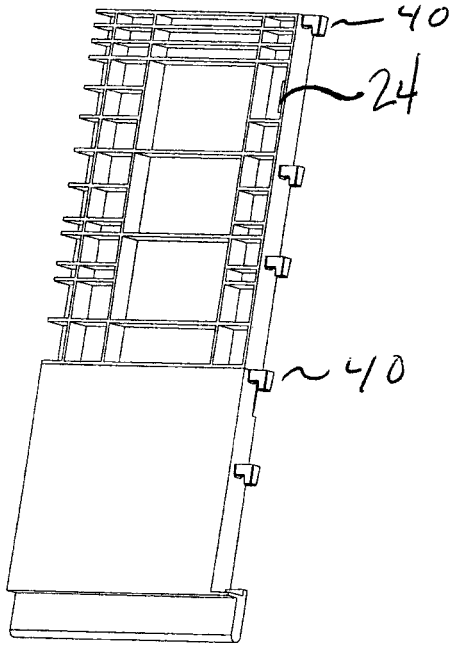
FIG. 7 is a perspective view of an exterior side of the side wall of FIG. 7.

The structure along the side edges of the side walls 22, 24 is more evident in FIGS. 6-9. Referring to FIGS. 6 and 7, the second side wail 24 includes a plurality of L-shaped projections 40 extending from the edge of the side wall 24 (only about half of each side wall 22, 24 is shown in FIGS. 4-10). Similar structure can be provided on the other side edge (not show) of the second side wall 24.

Figure 9:
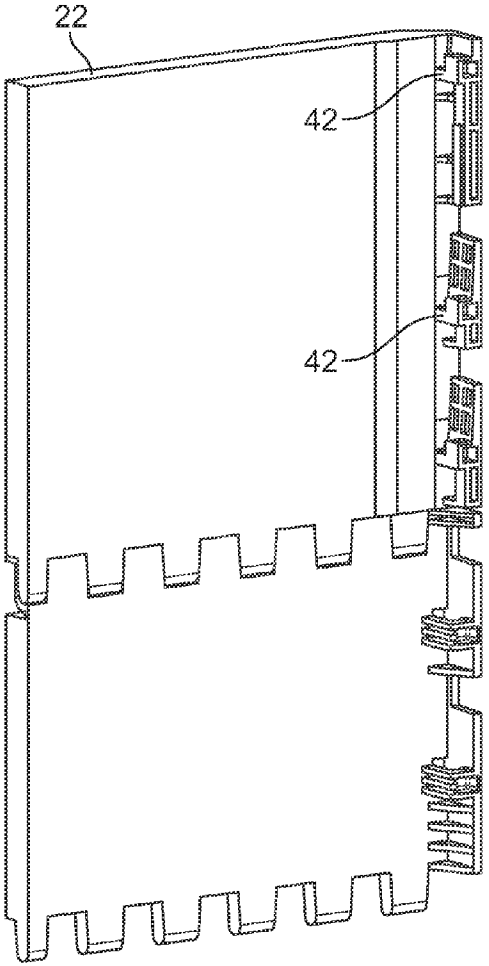
FIG. 9 is an enlarged perspective view of the side wall of FIG. 8.
Figure 8:
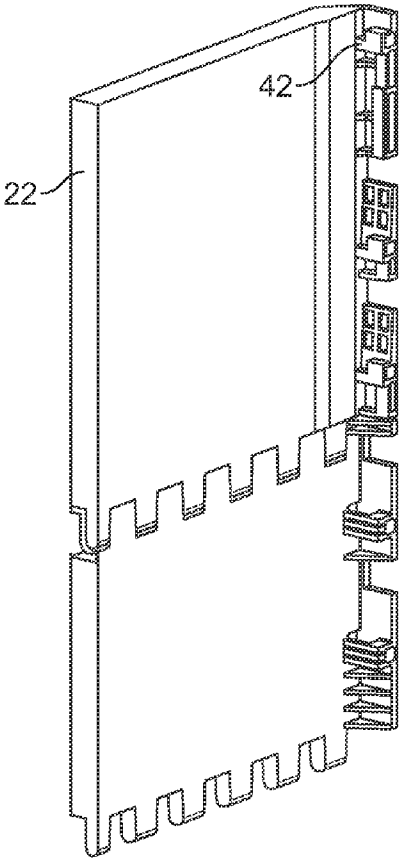
FIG. 8 is a perspective view of an interior side of a second one of the two side walls of FIG. 4.

The L-shaped projections 40 are sized to mate with pockets 42 on the side edge of the first side wall 22 as shown in FIGS. 8 and 9. Similar pocket structure can be provided on a third side wall to mate with L-shaped projections on the other side edge (not shown) of the second side wall 24.

Figure 10:
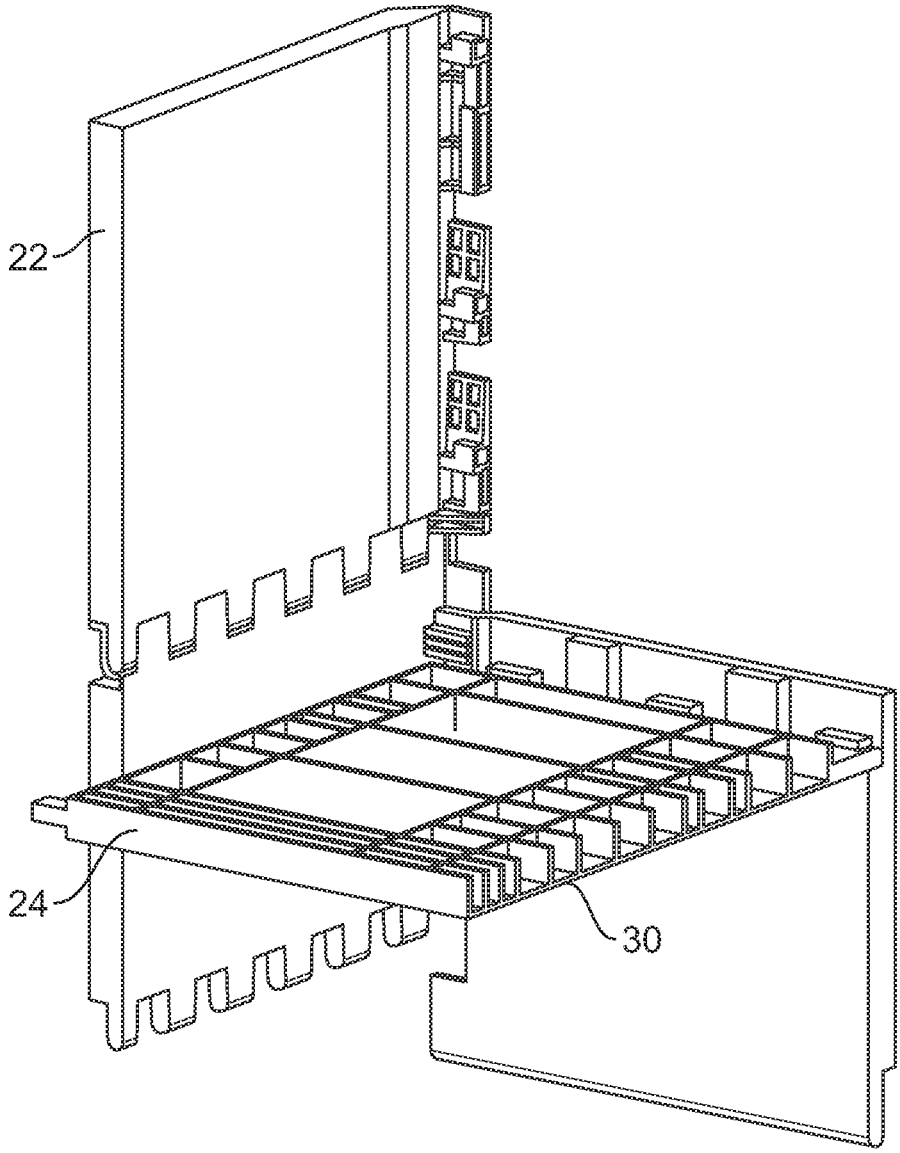
FIG. 10 is a perspective view of the interior side of the two side walls of FIG. 4 with the first side wall collapsed inwardly.

FIG. 10 shows the first and second side walls 22, 24 with the upper portion 30 of the second side wall 24 collapsed inward.

The embodiments shown include a collar or sleeve (i.e., the lower section of the various side walls) positioned proximate the base portion of the container. However, the container can implement the present invention without the collar or sleeve. In these embodiments, the upper sections of the side walls would be connected directly to the base portion.

Many modifications and variations of the present invention are possible in light of the above teachings. It is, therefore, to be understood within the scope of the appended claims the invention may be protected otherwise than as specifically described.

I claim:

1. A bulk bin container with a side wall that can be removed when in an upright position comprising:

a base portion having four sides;

a first side wall hingedly connected to a first side of the base portion, a second side wall hingedly connected to a second side of the base portion, a third side wall hingedly connected to a third side of the base portion, and a fourth side wall hingedly connected to a fourth side of the base portion, wherein the first side wall includes a first structure proximate a first side edge of the first side wall for removable connection to the second side wall, and a second structure on a second side edge of the first side wall for removable connection to the fourth side wall when all of the first, second, third and fourth side walls are in an upright position, the first structure and second structure configured to allow straight vertical movement of the first side wall from its upright position; and, a disengage-able hinge element connected to the base portion and the first side wall, wherein the disengage-able hinge element can be disengaged when the first side wall is in an upright position to enable vertical movement of the first side wall along a plane defined by the first side wall from the base portion while the first side wall is in the upright position.

2. The bulk bin container of claim 1 wherein the first structure is a plurality of L-shaped projections extending from the first side edge of the first side wall, and the second side wall includes a corresponding plurality of pockets configured to receive the L-shaped projections.

3. The bulk bin container of claim 1 wherein the first structure is a plurality of L-shaped projections extending from the second side edge of the first side wall, and the fourth side wall includes a corresponding plurality of pockets configured to receive the L-shaped projections.

4. The bulk bin container of claim 3 wherein the first side wall includes an upper portion and a lower portion, and the upper portion of each side wall is hingedly connected to the lower portion.

5. The bulk bin container of claim 1 wherein at least one of the first, second, third and fourth side walls includes a door hingedly connected to and forming part of the side wall to provide access to the interior of the container.

6. The bulk bin container of claim 1 wherein the first structure is a plurality of pegs extending from the first side edge and the second side wall includes a corresponding plurality of slots having an upper opening configured to receive the pegs.

7. The bulk bin container of claim 6 wherein the first structure is a plurality of pegs extending from the second side edge and the fourth side wall includes a corresponding plurality of slots having an upper opening configured to receive the pegs.

8. The bulk bin container of claim 1 wherein the disengage-able hinge element is a removable pin having a handle at a first end.

9. The bulk container of claim 1 further comprising a collar portion between the base portion and the first, second, third and fourth side walls.

10. A collapsible bulk bin container having a side wall that is removable when the container is in an un-collapsed state comprising:

a rectangular base portion having a first side, a second side, a third side and a fourth side;

a first side wall pivotably connected to the first side of the rectangular base portion by a disengage-able hinge element when the first side wall is upright, the first side wall having a plurality of L-shaped projections extending from a first side edge, and a plurality of L-shaped projections extending from a second side edge, the L-shaped projections extending from the first side edge and the second side edge of the first side wall configured to allow for upward vertical movement of the first side wall along a plane defined by the first side wall when in an upright position when the disengage-able hinge element is disengaged from the base portion;

a second side wall pivotably connected to the second side of the rectangular base portion, the second side wall having a plurality of pockets on a first side edge for receiving the L-shaped projections on the first side edge of the first side wall;

a third side wall pivotably connected to the third side of the rectangular base portion; and, a fourth side wall pivotably connected to the fourth side of the rectangular base portion, the fourth side wall having a plurality of pockets on a first side edge for receiving the L-shaped projections on the second side edge of the first side wall.

11. The collapsible bulk bin container of claim 10 is formed from plastic.

12. The collapsible bulk bin container of claim 10 further comprising an access door in one of the first, second, third and fourth side walls.

13. The collapsible bulk bin container of claim 10 wherein the disengage-able hinge element is a metal pin.

14. The collapsible bulk bin container of claim 10 wherein the L-shaped projections are configured so that upward movement of the first side wall by about 3 ¼ inches disengages the L-shaped projections from the pockets.

15. The collapsible bulk bin container of claim 10 wherein the L-shaped projections include an outermost portion extending downward.

16. A collapsible bulk bin container having a side wall that is removable when the container is in an un-collapsed state comprising:

a rectangular base portion having a first side, a second side, a third side and a fourth side;

a first side wall pivotably connected to the first side of the rectangular base portion by a disengage-able hinge element when the first side wall is upright wherein the first wall can move vertically upward along a plane defined by the first wall when upright when the disengage-able hinge element is disengaged, the first side wall having a plurality of pockets along a first side edge, and a plurality of pockets along a second side edge;

a second side wall pivotably connected to the second side of the rectangular base portion, the second side wall having a plurality of projections on a first side edge for connection to the pockets on the first side edge of the first side wall;

a third side wall pivotably connected to the third side of the rectangular base portion; and, a fourth side wall pivotably connected to the fourth side of the rectangular base portion, the fourth side wall having a plurality of projections on a first side edge for connection to the pockets on the second side edge of the first side wall.

17. The collapsible bulk bin container of claim 16 wherein the plurality of projections on the second side wall and the plurality of projections on the fourth side wall are L-shaped projections.

18. The collapsible bulk bin container of claim 17 wherein the L-shaped projections include an outermost portion extending upward.

19. The collapsible bulk bin container of claim 16 is formed from plastic.

* * * * *

UNITED STATES PATENT AND TRADEMARK OFFICE

CERTIFICATE OF CORRECTION

PATENT NO. : 8,950,613 B2
APPLICATION NO. : 13/397025
DATED : February 10, 2015
INVENTOR(S) : Roger Nolan It is certified that error appears in the above-identified patent and that said Letters Patent is hereby corrected as shown below:

In the Claims

Column 6, Line 48, in Claim 9, after “bulk” insert --bin--

Signed and Sealed this
Second Day of June, 2015

Michelle K. Lee

Michelle K. Lee
*Director of the United States Patent and Trademark Office*